United States Patent [19]

Tata

[11] 4,267,924

[45] May 19, 1981

[54] CIGARETTE CONTAINER AND LIGHTER COMBINATION

[76] Inventor: Peter Tata, 404 E. LaSalle Ave., Royal Oak, Mich. 48073

[21] Appl. No.: 62,044

[22] Filed: Jul. 30, 1979

[51] Int. Cl.[3] ..... A24F 15/00; A24F 15/10; A24F 15/18

[52] U.S. Cl. ..... 206/87; 206/267; 206/236; 220/254; 431/343

[58] Field of Search ..... 206/87, 88, 89, 236, 206/267; 220/254; 431/343

[56] References Cited

U.S. PATENT DOCUMENTS

| | | | |
|---|---|---|---|
| 2,043,888 | 6/1936 | Denit | 206/87 |
| 2,475,896 | 7/1949 | Husted | 206/267 |
| 2,782,910 | 2/1957 | Leibow | 206/87 |
| 3,069,886 | 12/1962 | Coats | 431/343 |
| 3,178,016 | 4/1965 | Coats | 206/87 |
| 3,179,891 | 4/1965 | Sharma | 206/87 |
| 3,608,704 | 9/1971 | Kopp | 206/87 |
| 3,976,194 | 8/1976 | Loredo | 206/87 |
| 4,000,812 | 1/1977 | Pisarski et al. | 206/87 |

*Primary Examiner*—William T. Dixson, Jr.
*Attorney, Agent, or Firm*—Remy J. VanOphem

[57] ABSTRACT

A cigarette lighter is movably mounted to the top of a cover which is mounted to a container in which the cigarettes are stored. In one position, the cigarette lighter covers an opening in the top of the cover and in the other position uncovers the opening thereby permitting the dispensing of at least one cigarette through the top of the cover. The cover and the container are adjustable to accommodate various lengths of cigarettes. The cigarette lighter is disposable or refillable and is either of the electric type or fueled by butane gas.

10 Claims, 14 Drawing Figures

CIGARETTE CONTAINER AND LIGHTER COMBINATION

BACKGROUND OF THE INVENTION

1. Field of the Invention

The present invention relates to the field of cigarette lighters in general and in particular to that portion of the field of cigarette lighters which relates to cigarette lighter and case combinations.

2. Brief Description of the Prior Art

Cigarette lighter and case combinations of the general type described herein are well known in the art. For example, U.S. Pat. No. 1,819,427 shows a container in which the cigarettes are stored with a top which is attached to the container by a hinge. The top contains a liquid fuel lighter mechanism and a liquid fuel container. This type of lighter and case combination is expensive to fabricate and requires both hands to operate the combination. Furthermore, the combination is not adjustable to the various cigarette configurations widely available today nor is it disposable. Lastly, because it is of the liquid fuel type, it emits fuel fumes which may be absorbed by the cigarettes and therefore spoil the taste of the cigarettes.

A more advanced design is described in U.S. Pat. No. 1,903,729. A liquid fuel lighter mechanism with a liquid fuel container are slidably engaged to the end wall of a cigarette pack. While this design permits one handed operation of the combination, it is not adjustable to fit the various cigarette configurations widely available today, it is not disposable, and it emits fuel fumes which may be absorbed by the cigarettes and, therefore, may spoil the taste of the cigarettes.

U.S. Pat. No. 2,043,888 describes another advance in the art wherein, a package of cigarettes and a liquid fuel lighter mechanism and fuel chamber are combined into one structure. This structure has a body portion and a telescoping top which fits over the package of cigarettes encased within the body portion. The liquid fuel lighter mechanism is secured to the bottom of the body portion of the structure. This configuration requires both hands to operate, it is not disposable, and emits fuel fumes which may spoil the taste of the cigarettes.

A further advance in the prior art is represented in U.S. Pat. No. 2,782,910. Here a liquid fuel lighter mechanism and liquid fuel chamber are mounted on a cover which is hinged to a rigid frame which is mounted on a cigarette pack. The frame is releasably locked to the cigarette pack and includes a lock mechanism for securing the hinged cover to the frame. This configuration is not readily adjustable to the various cigarette configurations of cigarettes widely available today, it is expensive to fabricate, and is not disposable. Furthermore, it emits fuel fumes which may spoil the taste of the cigarettes.

A more recent advance in the art is shown in U.S. Pat. No. 3,608,704 which relates to a combined liquid fuel lighter mechanism and fuel chamber slidably mounted to the top of a "soft pack" cigarette pack to form a closure for covering the top of the cigarette pack. While this invention permits one hand operation and fits all sizes of cigarettes, this design is not disposable and it emits fuel fumes which may spoil the taste of the cigarettes.

Representative of a more advanced design is U.S. Pat. No. 3,976,194 wherein a disposable lighter mechanism is adapted to the usual type of cigarette pack as a standard part of the pack which, when the cigarette pack is empty, is discarded. Such a combination is not reusable and reduces the number of cigarettes per pack.

None of the aforementioned designs teach a combination cigarette container and lighter which is either reusable or disposable, permits one hand operation, is inexpensive to manufacture, is adaptable to the various cigarette configurations widely available today, and which does not affect the taste of the cigarettes since no fuel fumes are emitted.

SUMMARY OF THE INVENTION

The present invention is a combination cigarette container and lighter wherein the cigarette lighter is movably mounted to the top of the closure of the container wherein the cigarettes are stored. With this invention, the user can move the lighter from a first position covering an opening in the top of the closure to a second position uncovering the opening in the top of the closure, thereby permitting the dispensing of at least one cigarette therethrough. The present invention is further characterized by the fact that it is designed to accommodate both a disposable or refillable type of cigarette lighter and is adapted to use either an electric or butane gas lighter.

It is, therefore, a primary object of this invention to combine a cigarette container and lighter into one structure, conveniently located to one another in order to permit one hand operation of the combination, to be adjustable to the various lengths of cigarettes commercially available and does not affect the taste of cigarettes.

It is another object of this invention to design a disposable or refillable lighter structure, large enough to contain sufficient fuel to service an entire pack of cigarettes and small enough as to minimize the space required for the lighter and to design the cigarette container to accommodate a complete cigarette pack therein.

Another object of this invention is to design the cigarette container so as to accommodate cigarettes in a soft pack or hard pack configuration and to provide a refillable or disposable lighter that is either electrically operated or fueled by butane gas so that the lighter does not give off fumes and affect the taste of cigarettes.

It is still another object of this invention to provide a lighter that is either electrically operated or fueled by butane gas so that the lighter does not give off fumes which affect the taste of cigarettes and to design the cigarette container to accommodate a complete cigarette pack therein.

It is still another object of the invention to design the combination so that it fits compactly in a shirt pocket, suit pocket, or purse, to design a combination that is either reusable or disposable and to permit the manufacture of this design at a cost sufficiently low to make the design commercially feasible.

BRIEF DESCRIPTION OF THE DRAWINGS

Other objects and advantages of the invention will become apparent upon reading the following description and upon reference to the drawing, in which.

DETAILED DESCRIPTION OF THE PREFERRED EMBODIMENT

Figure 1:
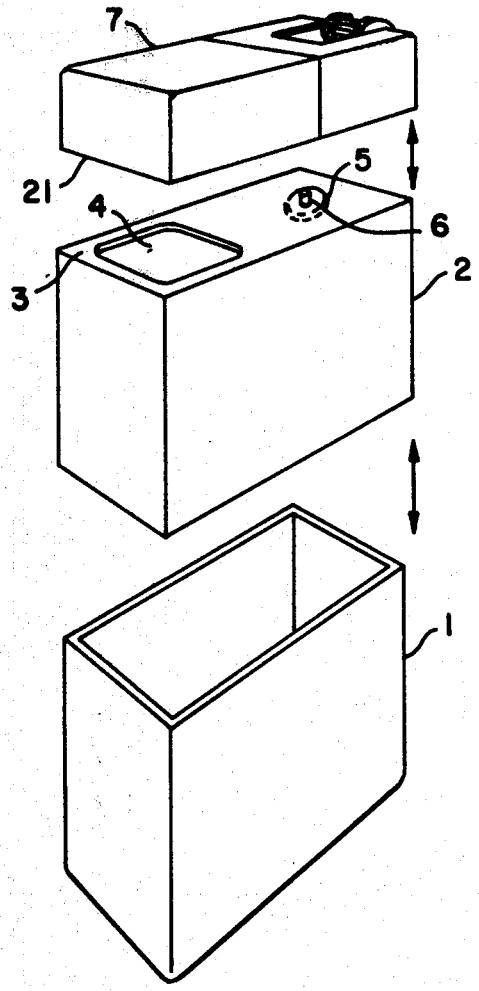
FIG. 1 is a perspective view of the combination cigarette container and lighter with the lighter disassembled from the cover of the container, and the cover of the cigarette container disassembled from the container.
Figure 2:
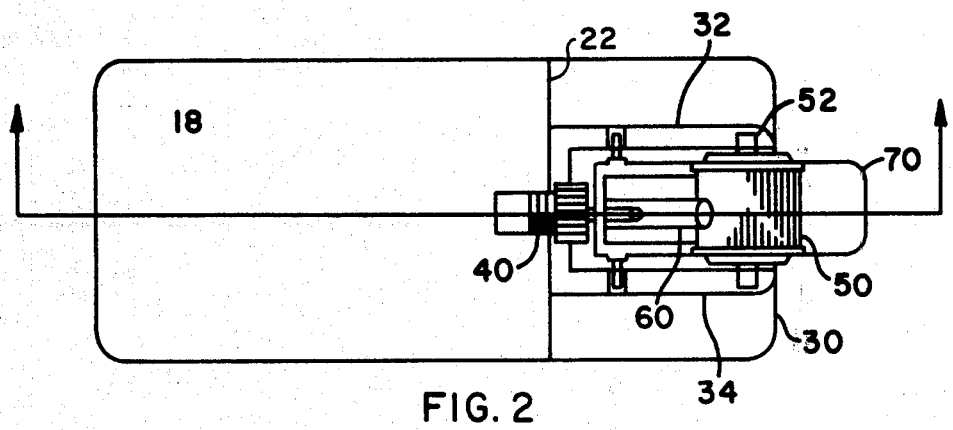
FIG. 2 is a top view of the lighter structure.
Figure 3:
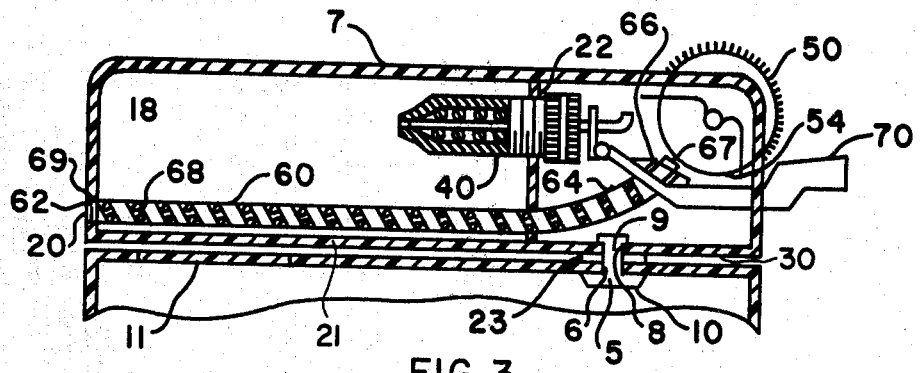
FIG. 3 is a sectional view of the lighter structure along 2—2 of FIG. 2 and also shown in relationship to a partial sectional view of the cover of the cigarette container shown in FIG. 1.

The combination cigarette lighter and container is illustrated in FIGS. 1, 2, and 3. In FIG. 1, the cigarettes (not shown) are enclosed within a container 1 which has a telescoping cover 2. The container 1 and cover 2 are adjustable to accommodate the many different types and sizes of cigarettes commercially available. The container 1 and the cover 2 are of thin wall construction and may be made from any suitable material such as plastic or metal. On the top 3 of the cover 2 is an opening 4 of sufficient size to permit at least three or four cigarettes of the largest size to pass therethrough. The opening 4 can be located on either the right hand or left hand side of the top but it must be in opposite relationship with a hole 6 through the top 3.

As shown in FIGS. 3 and 1, the swivel pin 5 is inserted through hole 6 such that its head 10 is flush with the interior surface 11 of the top 3. The swivel pin 5 may be made from a rivet or any other suitable fastener.

The lighter structure 7 includes a flat rectangular base 21 with a hole 8 into which the shaft 9 of the swivel pin 5 is inserted. The shaft 9 of the swivel pin 5 may be swagged into the hole 8, cemented, glued, or fastened to the base by any suitable means. Interposed the base 21 and the top 3 of the cover 2 is a detent ring 23 mounted about the shaft 9 of the swivel pin 5 so as to limit the rotational movement of the lighter structure about the axis of the swivel pin 5.

FIG. 3 shows the preferred embodiment of the lighter structure 7. The lighter structure 7 includes a flat rectangular base 21 having a fuel reservoir 18 mounted horizontally to the base 21, a support structure 30 mounted on the remaining portion of the base 21, a fuel valve 40 mounted horizontally into the side of the fuel reservoir 18 and through the support structure 30, a spark wheel 50 mounted on the support structure 30, a flint tube 60 and a combustion activating mechanism 70 mounted on the support structure 30.

As shown in FIG. 2, the fuel reservoir 18 is of any suitable shape and size so long as it contains an adequate mixture of liquid and gaseous butane fuel (not shown) to serve an entire package of cigarettes. The fuel reservoir 18 is also of such physical dimensions so that the supporting structure 30, the fuel valve 40, spark wheel 50, flint tube 60 and combustion activating mechanism 70 can be arranged to fit on the remaining portion of the base 21 as shown in FIG. 3. The fuel reservoir may be made from plastic or metal or any suitable material.

As shown in FIG. 2, the supporting structure 30 comprises two projections 32, 34 which are mounted horizontally to the base 21 on the remaining portion of the base not occupied by the fuel reservoir 18. One end of the projections 32, 34 are mounted perpendicular to the wall 22 of the fuel reservoir 18. The spark wheel 50 is mounted on a spindle 52 which is rotatably mounted to the projections 32, 34. The supporting structure 30 may be made from metal or any other suitable material.

As shown in FIG. 3, a flint tube 60 is mounted on the top of the base 21 such that the tube 60 is placed lengthwise through the fuel reservoir 18. The flint tube 60 terminates at one end at the outside edge 20 of the base 21 with a threaded connection 62. The other end of the flint tube 60 protrudes through side 22 of the fuel reservoir 18 and then is projected upward from the base 21 at a slight angle 64 and terminates at a point 66 which is adjacent to the surface 54 of the spark wheel 50. The flint tube 60 is made from plastic or any other suitable material. A piece of round flint 67 is inserted into the flint tube 60 through the threaded connection 62. After the flint 67 is inserted into the flint tube 60, a spring coil 68 of suitable length is inserted into the flint tube 60. A threaded plug 69 engages the threaded connection 62 of the flint tube 60 and acts to compress the spring coil 68 to push the flint 67 against the surface 54 of the spark wheel 50.

Figure 4:
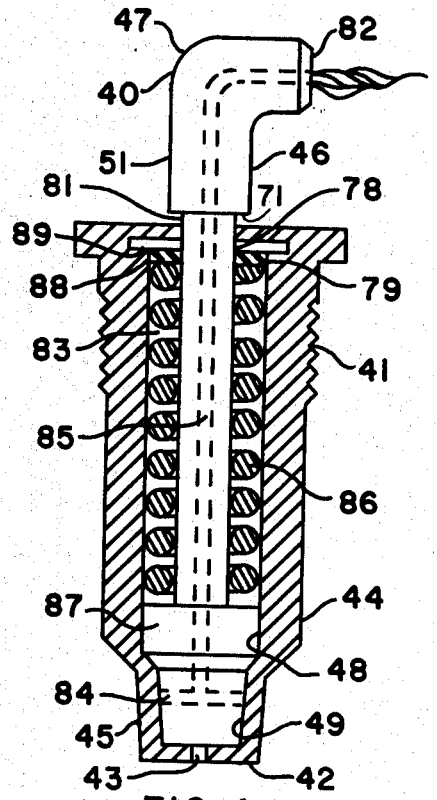
FIG. 4 is a sectional view of the fuel valve in the closed position.

As shown in FIG. 4, the fuel valve 40 includes threaded body 41 which is mounted horizontally into the fuel reservoir 18 as shown in FIG. 3. Returning back to FIG. 4, one end 42, of the fuel valve 40 protrudes into the fuel reservoir 18. The threaded body 41 has a generally cylindrical outer shape 44 which terminates in a tapered blunt end 45. The threaded body 41 also has a generally cylindrical inner passage 48 which terminates in a tapered inner cavity 49. The tapered cavity 49 communicates with the fuel reservoir through hole 43 in the end 42. The threaded body 41 is made from metal or any suitable material.

An "L shaped" tube 46 having a 90° short bend 47 which terminates at 82 on one end is fabricated from steel or other suitable heat resistant material. The tube 46 has a generally smaller outer diameter 81 from the other end of the tube 46 until the larger diameter 51 of the 90° bend 47. The smaller outer diameter 81 is encassed in a generally cylindrical sleeve 83 made from plastic or other suitable resilient material which is made to closely conform to the cylindrical inner passage 48 and the tapered inner cavity 49. The sleeve 83 terminates at one end with a tip 87 which has a series of diametrical holes 84 which connect to the inner diameter 85 of the tube 46.

A compression spring 86 biases the tip 87 against the tapered inner cavity 49 to prevent the flow of gas from the fuel reservoir through the hole 43, into the passage 49, and into the holes 84 and thence into the inner diameter 85 of the tube 46.

A resiliently O ring seal 88 of a predetermined thickness with an outer diameter 79 which is slightly larger than the inner passage 48 and an inner diameter 78 which is slightly smaller than the outer diameter 81 of the tube 46. The seal 88 is placed around the outer diameter 81 of the tube 46 and is sandwiched between the spring 86 and a circular metal stop 89 which is placed around the outer diameter 81 of the tube 46. The stop 89 retains the tube 46, tip 87, seal 88 and spring 86 in the cylindrical inner passage 48 and the tapered inner cavity 49. The metal stop 89 is fastened to the fuel valve 40 by any conventional method such as staking, soldering, cementing, or any other suitable means.

Figure 6:
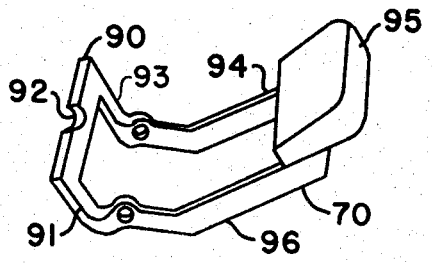
FIG. 6 is a perspective view of the combustion activating mechanism.

As shown in FIG. 3, the fuel valve 40 is threaded, cemented, or glued through the supporting structure 30 and the fuel reservoir 18. The supporting structure 30 is fastened to the side 22 of the base 21 and fuel reservoir 18 by moulding, cementing, glueing or other suitable means. As shown in FIG. 6, the combustion mechanism 70 includes a finger actuating plate 95 on one end which is located near and under the spark wheel 50 (as shown in FIG. 3). Returning back to FIG. 6, the other end of the combustion mechanism 70 includes a burner valve actuation plate 90 which comprises a U shaped notch 92 in the top edge of the plate and two connectors 91, 93. Two connectors 94, 96 are connected to the two connectors 91, 93 to hold the finger actuating plate 95 in spaced relationship to the burner valve actuation plate 90. The burner valve actuation plate 90 engages the smaller outer diameter 81 of the tube 46 by acting on a shoulder 71 which is formed at the junction of the small outer diameter 81 and the larger diameter of the 90° bend 47 of the tube 46 as shown in FIG. 4.

The operation of the preferred embodiment is as follows: The lighter structure 7 is swung about the axis of the swivel pin 5 in either a clockwise or counterclockwise direction to a first position determined by the detent ring 23 to expose the opening 4 in the top 3 as shown in FIG. 1. The combination is thus positioned such that the user can extract a cigarette from within the container 1 through the opening 4 in the cover. Upon extracting the cigarette, the lighter structure 7 is moved into its second predetermined position wherein, the opening 4 in the top 3 is hidden by the lighter structure 7. The user then places his finger on the upper surface of the spark wheel 50 after which he shifts his finger onto the side of the lighter structure to the finger actuating plate 95 of the combustion activating mechanism 70 so as to impact to the spark wheel a rotary motion.

Figure 5:
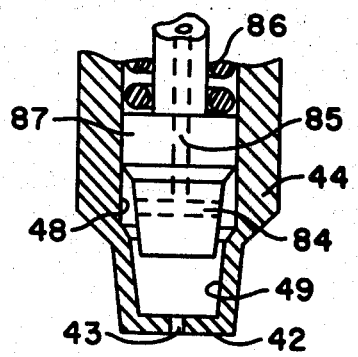
FIG. 5 is a partial sectional view of the fuel valve in the open position.

To permit the escape of fuel through the fuel valve 40, the user depresses the finger actuating plate 95 of the combustion actuating mechanism 70 to overcome the bias of the spring 86 and the seal 88 thereby causing the burner valve actuating plate 90 and the tube 46 to move horizontally. With this horizontal movement, the tip 87 of the tube 46 will move from its closed position shown in FIG. 4 to the open position shown in FIG. 5. Thus, fuel will flow from the fuel reservoir 18 through the hole 43 into the threaded body 41 into passages 49 and 48 then through the diametrical holes 84 in tip 87, and finally through the inner diameter 85 in the tube 46. Since the gas flow begins as soon as the user's finger depresses the actuating plate 95, that is, simultaneously with the movement of the user's finger over the spark wheel 50 and the very instant the first of a series of sparks is generated, the gas is exposed to an entire series of sparks. Thus, reliable ignition is assured enabling the user to light his cigarette.

Finally, when the user removes his finger from the combination actuating plate 95, the fuel valve 40 is returned to its closed position as shown in FIG. 4 because of the action of the bias of the spring 86 and the seal 88.

Figure 7:
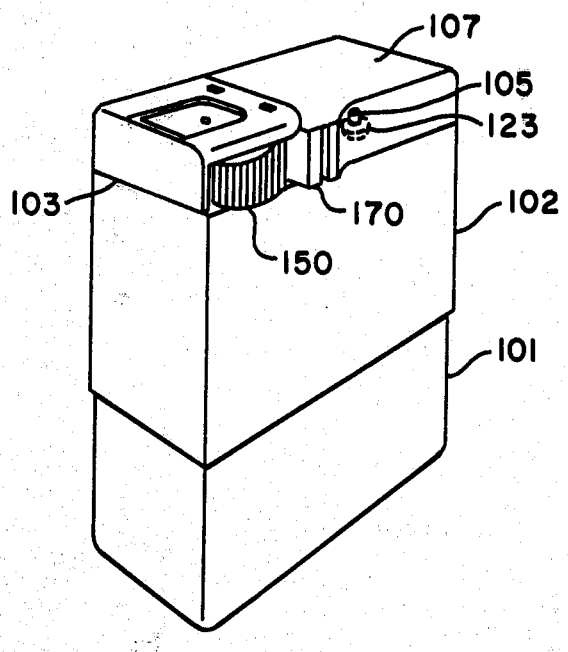
FIG. 7 is a perspective view of the combination cigarette container and lighter of a second embodiment with the lighter assembled to the cover of the cigarette container.

FIG. 7 shows a second embodiment. Here, as in the preferred embodiment, the cigarettes (not shown) are enclosed within a container 101. The container 101 has a telescoping cover 102 with a top 103. The top 103 has an opening 104 (not shown) in spaced relationship to a swivel pin 105 and detent ring 123.

The lighter 107 is similar in all other respects to the preferred embodiment except that the spark wheel 150 and combustion actuating mechanism 170 is mounted on its side.

Figure 8:
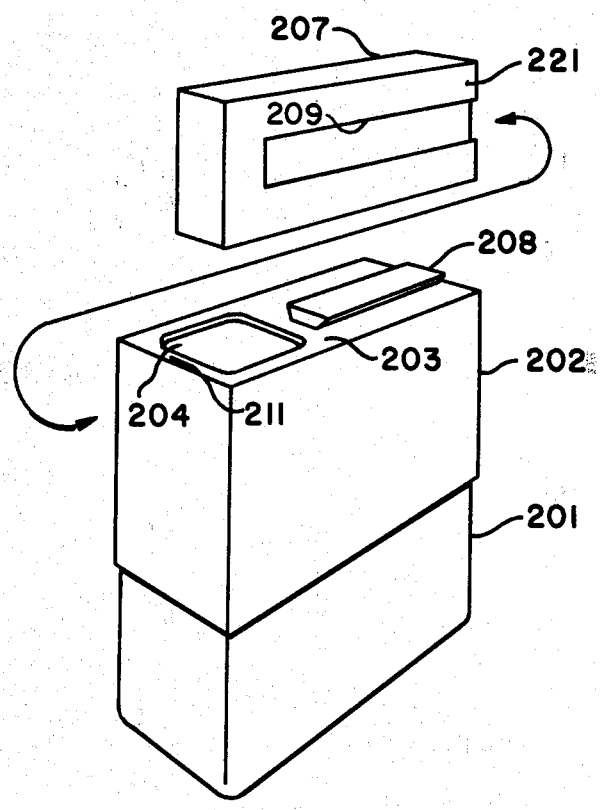
FIG. 8 is a perspective view of the combination cigarette container and lighter of a third embodiment with the lighter disassembled from the cover of the cigarette container.

The operation of this second embodiment is similar to the preferred embodiment except that the user actuates the spark wheel 150 and combustion actuating mechanism 170 from the side of the lighter 107. FIG. 8 illustrates a third embodiment. Here, as in the preferred embodiment, the cigarettes (not shown) are enclosed within the container 201 which has a telescoping cover 202. On the top 203 of the cover 202 is an opening 204 of sufficient size to permit at least three or four cigarettes of the largest size to pass therethrough. The opening 204 can be located on either the right hand or left hand side of the top 203 but it must be in opposite relationship with the outwardly raised track 208 moulded on or fastened to the top 203.

The lighter structure 207 is similar to the preferred embodiment except that it includes a base 221 which has an inwardly tapered recessed track 209 moulded or fastened to its bottom surface. The inwardly tapered recessed track 209 is congruous with the outwardly tapered raised track 208 fastened to the top 203 so that the lighter structure 207 is slidably engaged to the cover 202 by engagement of the recessed track 209 with the raised track 208. A stop 211 is fastened to the end of the recessed track 209 to limit the travel of the lighter structure on the top of the cover.

The operation of this third embodiment is similar to the preferred embodiment except:

The lighter structure 207 is moved along the central axis of the engaged tracks 208 and 209 to a first position as set by the limit of stop 211 to uncover the opening 204 on the top 203. After removing a cigarette, the lighter structure 207 is returned to a second position wherein, the opening 204 in the top 203 is hidden by the lighter structure 207 and the further operation to light the cigarette of this third embodiment is the same as the preferred embodiment.

Figure 9:
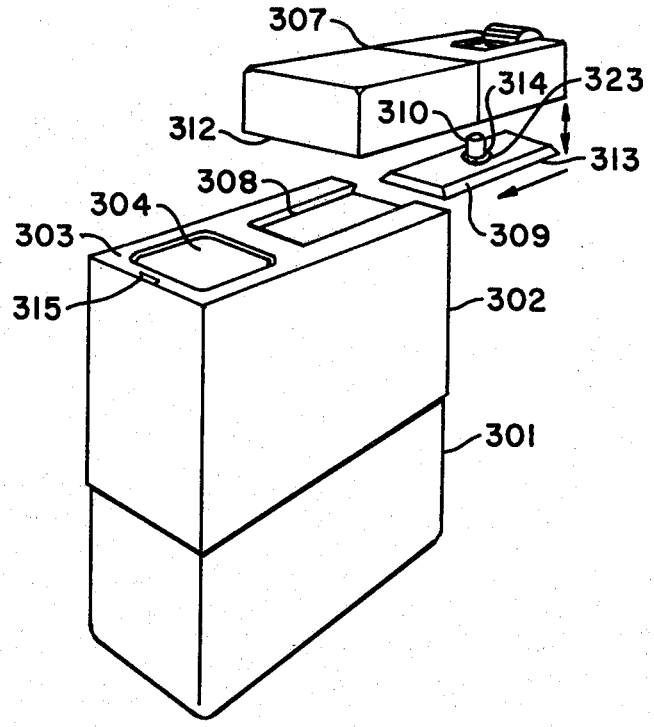
FIG. 9 is a perspective view of the combination cigarette container and lighter of a fourth embodiment with the lighter disassembled from a platform and from the cover of the cigarette container.
Figure 10:
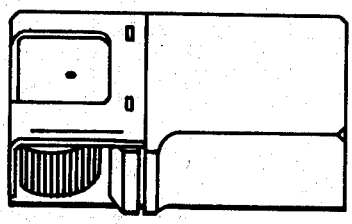
FIG. 10 is a perspective view of a fifth embodiment.
Figure 11:
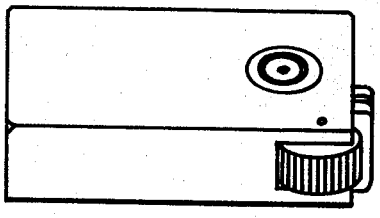
FIG. 11 is a perspective view of a sixth embodiment.
Figure 12:
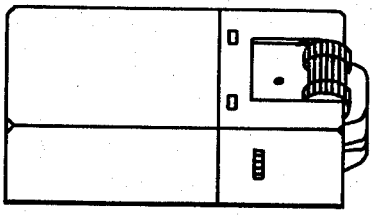
FIG. 12 is a perspective view of a seventh embodiment.
Figure 13:
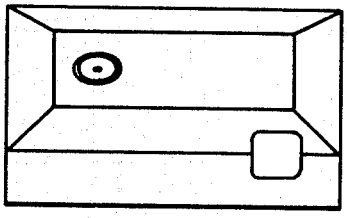
FIG. 13 is a perspective view of an eighth embodiment.
Figure 14:
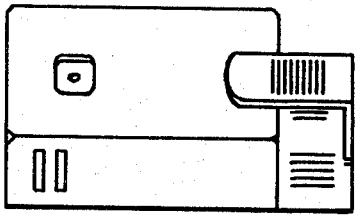
FIG. 14 is a perspective view of a ninth embodiment.

In further keeping with this invention, FIG. 9 illustrates a fourth embodiment. Here, as in the preferred embodiment, the cigarettes (not shown) are enclosed within the container 301 which has a telescoping cover 302. On the top 303 of the cover 302 is an opening 304 of sufficient size to permit at least three or four cigarettes of the largest size to pass therethrough. The opening 304 can be located on either the right hand or left hand side of the top 303 but it must be in opposite relationship with the inwardly recessed track 308 moulded on or fastened to the top 303 as shown in FIG. 9.

The lighter structure is generally designated 307 and is similar to the preferred embodiment in that it includes a base 312 with a hole 311 through its bottom (not shown).

A platform 313 is interposed the lighter structure 307 and the top of the cover 303. The platform 313 has a inwardly tapered recessed track 309 moulded or fastened to its bottom surface. The inwardly tapered recessed track 309 is congruous with the inwardly recessed track 308 on the top 303. The platform 313 has a hole 314 in its top into which a swivel pin 310 is inserted. The swivel pin 310 has no head and may be swaged, pressed, cemented or glued into the holes 311 and 314. Between the bottom of the housing 312 and the top of the platform 313 is a detent ring 323 mounted to the shaft of the swivel pin 310 to limit the rotational movement of the lighter structure about the axis of the swivel pin. The bottom of platform 313 is slidably engaged to the top of the cover 303 by engagement of the recessed track 309 with the raised track 308. A stop 315 is fastened to the top 303 near the hole 304 to limit the travel of the platform 313 on the top of the cover.

The operation of the fourth embodiment is similar to the operation of the preferred and second embodiments except that:

The lighter structure 307 is moved along the central axis of the engaging tracks 308 and 309 or swung either clockwise or counterclockwise about the axis of the swivel pin 310 or a combination of the sliding and turning motions described above to a first position set by the limit of stop 315 or the detent ring 323 to expose the opening 304 in the top 303. After removing a cigarette, the lighter structure 307 is returned to a second position wherein, the opening 304 in the top 303 is hidden by the lighter structure 307 and the further operation to light the cigarette of this third embodiment is the same as the preferred embodiment.

FIGS. 10, 11, 12, 13, and 14 depict various other embodiments of the cigarette lighter structure to a cigarette container. All the embodiments shown are intended to be interpreted as illustrative and not in a limiting sense.

The lighter structure that is illustrated is fueled by butane or similar fuel. It may be either disposable or refillable. Any other types of inexpensive lighter structure such as an electrical igniter, which is operated by a dry cell battery (not illustrated), may also be used.

While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim is:

1. A cigarette container and lighter combination adapted to receive cigarettes therein comprising:

a container having a bottom closure and an opening opposite said bottom closure;

a cover slidably mounted to said container, said cover having a top closure and an opening opposite said top closure, said top closure having an opening of predetermined size near three edges of said top closure;

means for dispensing said cigarettes so that the travel of said dispensing means is limited from a first predetermined closed position to a second predetermined open position;

means for mounting said dispensing means to said top closure so that at least one cigarette is dispensed through said hole in said top closure when said dispensing means is in a second predetermined position; and means mounted to said dispensing means for lighting said cigarettes.

2. A cigarette container and lighter combination of claim 1 wherein said dispensing means further comprises:

a flat base; and means for limiting the movement of said flat base.

3. A cigarette container and lighter combination of claim 2 wherein said lighting means further comprises:

a fuel receptacle; and means for igniting the cigarettes.

4. A cigarette container and lighter combination of claim 3, wherein said means for mounting said dispensing means further comprises:

a swivel pin;

said top closure having a hole of predetermined size located near the edge opposite said opening in said top closure through which the shaft of said swivel pin is inserted; and said flat base having a bottom with a hole of predetermined size into which said swivel pin is inserted.

5. A cigarette container and lighter combination of claim 3 wherein said means for mounting said dispensing means further comprises:

said closed end of said top closure having an outwardly raised track; and said flat base having an inwardly recessed track mounted on the bottom of said base which is congruous with said outwardly raised track mounted on said closed end of said top closure, and which is engaged to said top closure.

6. A cigarette container and lighter combination of claim 3 wherein said means for mounting said dispensing means further comprises:

said closed end of said top closure having an outwardly raised track mounted thereon in opposed relationship to said opening in said top closure;

a platform, having a top and a bottom, said top having a hole of predetermined size and said bottom having an inwardly tapered recessed track with in congruous with said outwardly raised track mounted on said closed end of said cover, and which is slidably engaged to said top closure;

a swivel pin inserted into said hole in said platform; and said flat base having a bottom with a hole of predetermined size into which said swivel pin is inserted.

7. A cigarette container and lighter combination as recited in claim 4, wherein said limiting means further comprises:

a detent mounted on said swivel pin shaft.

8. A cigarette container and lighter combination as recited in claim 5, wherein said limiting means further comprises a stop on said recessed track.

9. A cigarette container and lighter combination as recited in claim 6, wherein said limiting means further comprises a stop on said recessed track.

10. A cigarette container and lighter combination as recited in claim 6, wherein said limiting means further comprises a detent on said swivel pin shaft.

* * * * *